US008333084B2

(12) United States Patent
Park

(10) Patent No.: US 8,333,084 B2
(45) Date of Patent: Dec. 18, 2012

(54) REFRIGERATOR AND LIGHTING DEVICE THEREFOR

(75) Inventor: Jin-Woo Park, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 409 days.

(21) Appl. No.: 12/724,618

(22) Filed: Mar. 16, 2010

(65) Prior Publication Data

US 2011/0072842 A1 Mar. 31, 2011

(30) Foreign Application Priority Data

Sep. 30, 2009 (KR) ..... 10-2009-0093484

(51) Int. Cl.
*F25D 23/00* (2006.01)

(52) U.S. Cl. ..... 62/264; 62/340; 62/389

(58) Field of Classification Search ..... 62/264, 62/389, 340, 440, 449; 362/92, 140, 236
See application file for complete search history.

(56) References Cited

U.S. PATENT DOCUMENTS

| | | | | |
|---|---|---|---|---|
| 6,351,958 | B1 * | 3/2002 | Pastryk et al. | 62/137 |
| 6,442,954 | B1 * | 9/2002 | Shapiro et al. | 62/137 |
| 6,684,648 | B2 * | 2/2004 | Faqih | 62/93 |
| 6,736,885 | B2 * | 5/2004 | Kaiser | 96/224 |
| 7,007,500 | B2 * | 3/2006 | Lee | 62/389 |
| 7,228,703 | B2 * | 6/2007 | Kim et al. | 62/353 |
| 2003/0047079 | A1 * | 3/2003 | Kaiser | 96/224 |
| 2005/0044871 | A1 * | 3/2005 | Nowak | 62/264 |

* cited by examiner

*Primary Examiner* — Mohammad Ali
(74) *Attorney, Agent, or Firm* — Fish & Richardson P.C.

(57) ABSTRACT

Disclosed are a refrigerator and a lighting device therefor. Since an optical source, an LED is installed at a height to overlap a guide member, light emitted from the LED is widely dispersed through the guide member. This may allow a user to easily check a discharged degree of ice cubes or water, and to have sophisticated aesthetic feeling. Furthermore, since the optical source is fixed to an optical source accommodation portion by being encompassed thereby, a water leakage prevention function may be enhanced, and an additional coupling member for coupling the optical source may not be required. This may allow the number of components and assembly processes to be decreased, and the production costs to be reduced.

17 Claims, 7 Drawing Sheets

REFRIGERATOR AND LIGHTING DEVICE THEREFOR

RELATED APPLICATION

The present disclosure relates to subject matter contained in priority Korean Application No. 10-2009-0093484, filed on Sep. 30, 2009, which is herein expressly incorporated by reference in its entirety.

BACKGROUND OF THE INVENTION

1. Field of the Invention

The present invention relates to a refrigerator and a lighting device therefor, and more particularly, to a refrigerator capable of enhancing an illumination effect for a dispenser, and a lighting device therefor.

2. Background of the Invention

Generally, a refrigerator serves to freshly store food items for a long time by controlling a refrigerating chamber or a freezing chamber to maintain a low inner temperature as a refrigerant repeatedly circulates through a refrigeration cycle including compression-condensation-expansion-evaporation. The refrigerator is considered as one of necessaries.

A large type of refrigerator being currently presented out is provided with a dispenser configured to take out ice cubes or water without opening a door. The dispenser may prevent cool air inside the refrigerator from leaking out, and may enhance a user's convenience because it is able to take out ice cubes or water without opening a door.

The conventional dispenser is provided with a dispenser housing installed at a concaved front surface thereof so that a cup can be disposed at a front surface of a freezing chamber door. A guide member configured to guide ice cubes to be taken out is downwardly protruding from an upper wall surface of the dispenser housing. And, a plurality of LEDs configured to downwardly illuminate inside of the dispenser housing are installed at both sides of the periphery of the guide member, i.e., the upper wall surface of the dispenser housing where an upper end of the guide member is fixed.

In the case where a plurality of LEDs are installed at the upper wall surface of the dispenser housing, the LEDs automatically emit light to downwardly irradiate the light when being selected by a user or when the dispenser is operated. Accordingly, the light emitted from the LEDs illuminates the entire space inside the dispenser housing.

However, the conventional lighting device has the following problems.

Firstly, since the LEDs are installed at the upper wall surface of the dispenser housing to emit light to the downward direction, a use has a difficulty in recognizing the amount of ice cubes or water contained in a cup with his or her naked eyes during nighttime when an illumination effect is low. To solve this problem, the LEDs may be arranged at a position where an illumination effect is high. However, in this case, the ice cubes or water may splash to damage the lighting device.

Secondly, since the LEDs are installed at the upper wall surface of the dispenser housing, light emitted from the LEDs is irradiated onto the dispenser housing as it is. This may cause a low visual effect during the illumination.

Thirdly, since additional components for fixing the LEDs are required, the number of the entire components and the number of assembly processes are increased. This may cause high production costs.

SUMMARY OF THE INVENTION

Therefore, an object of the present invention is to provide a refrigerator capable of enhancing an illumination effect under the same amount of light emission, and capable of enhancing a safe characteristic by enhancing a water leakage prevention function, and a lighting device therefor.

Another object of the present invention is to provide a refrigerator capable of enhancing a visual effect during illumination by using a dispersion characteristic of light, and a lighting device therefor.

Still another object of the present invention is to provide a refrigerator capable of reducing production costs by easily and stably fixing LEDs to an optical source accommodation portion, and a lighting device therefor.

To achieve these and other advantages and in accordance with the purpose of the present invention, as embodied and broadly described herein, there is provided a refrigerator, comprising: a refrigerator body; a refrigerator door coupled to the refrigerator body; an ice maker disposed at the refrigerator body or the refrigerator door, and configured to make ice cubes; a dispenser disposed at the refrigerator door; a duct disposed between the ice maker and the dispenser, and configured to guide the ice cubes made by the ice maker to the dispenser; a dispenser housing communicated with the duct, and having an ice discharge opening; an optical source disposed at the periphery of the ice discharge opening; and a guide member disposed at the ice discharge opening, and configured to guide discharge of the ice cubes, wherein a cover portion configured to cover the optical source is formed at the guide member.

To achieve these and other advantages and in accordance with the purpose of the present invention, as embodied and broadly described herein, there is also provided a lighting device for a refrigerator, comprising: a refrigerator body; a refrigerator door coupled to the refrigerator body; a dispenser disposed at the refrigerator door; an ice storage container disposed at the refrigerator body or the refrigerator door, and configured to store ice cubes therein; a duct disposed at the refrigerator door, and configured to guide the ice cubes stored in the ice storage container to the dispenser; a dispenser housing communicated with the duct, and having an ice discharge opening; a switch installed at the dispenser housing so as to selectively discharge ice cubes from the dispenser; an optical source disposed at the periphery of the ice discharge opening; and a guide member disposed at the ice discharge opening, and configured to guide discharge of the ice cubes, wherein the optical source is installed at the dispenser housing so as to be disposed between an upper end of the switch and the ice discharge opening.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Hereinafter, a refrigerator and a lighting device therefor according to the present invention will be explained in more detail with reference to the attached drawings.

Figure 1:
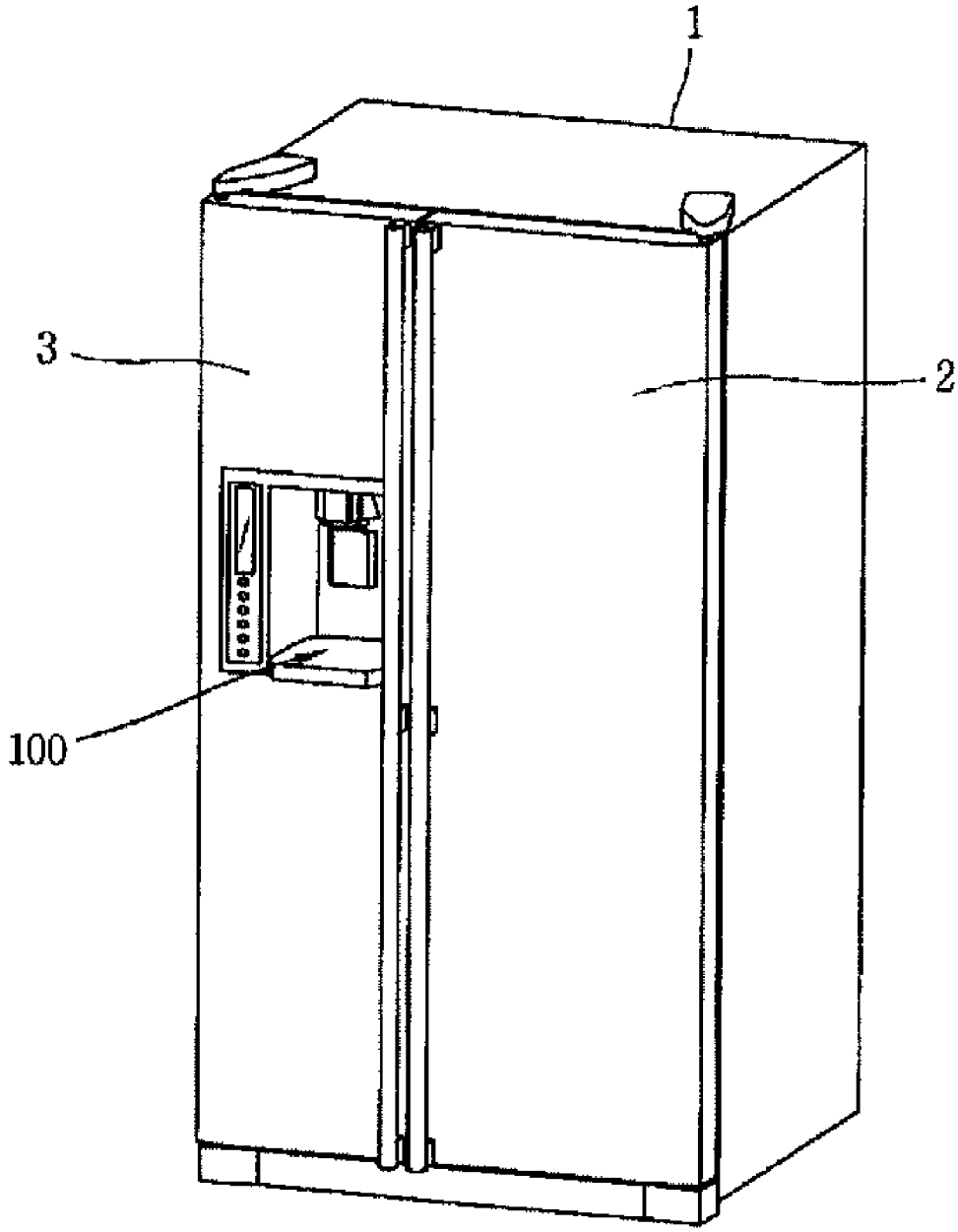
FIG. 1 is a perspective view of a refrigerator having a dispenser according to the present invention.
Figure 2:
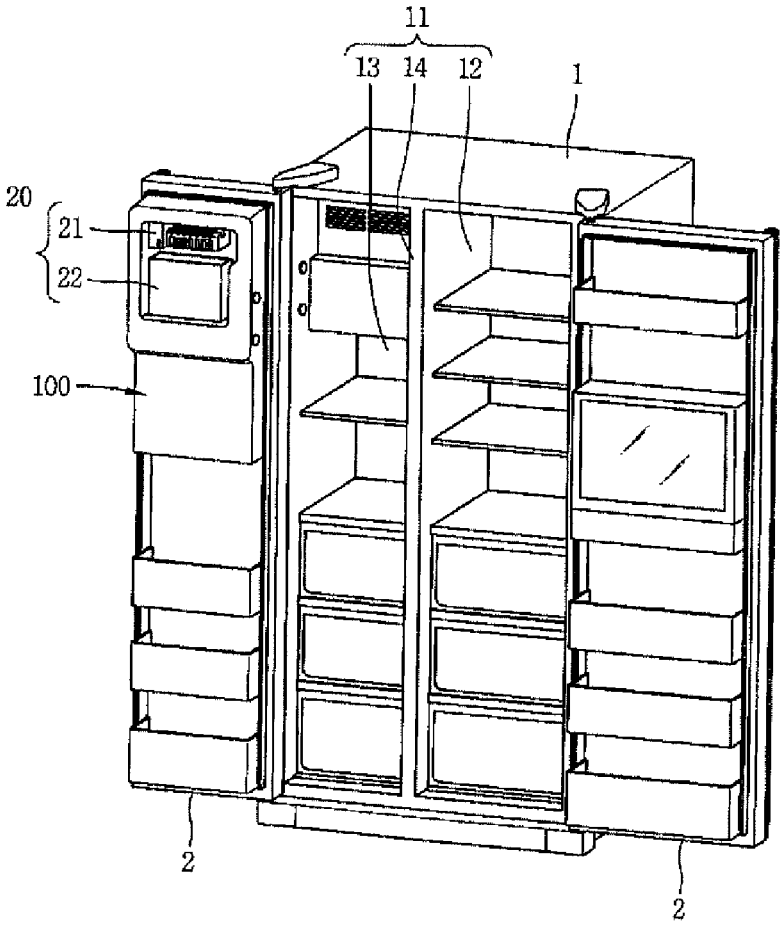
FIG. 2 is a perspective view of the refrigerator having a dispenser according to the present invention, which shows a state that a door has opened.
Figure 3:
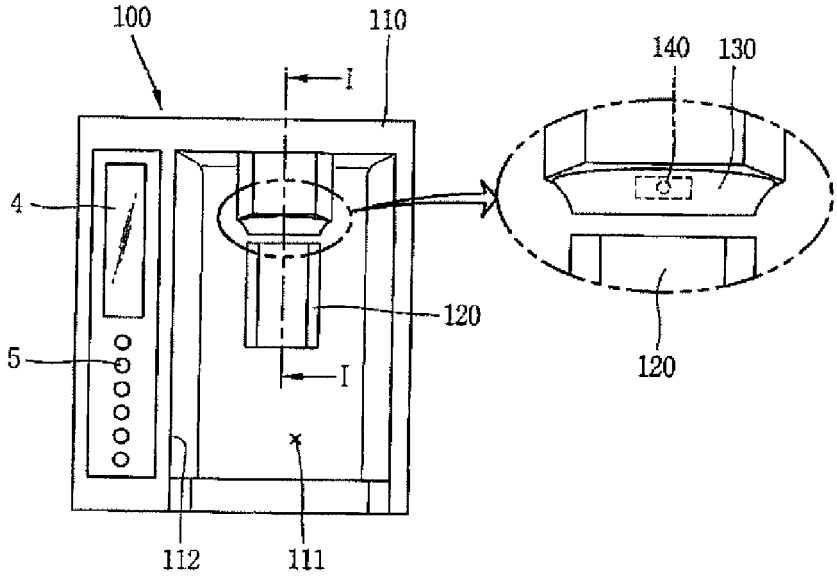
FIG. 3 is a frontal view of the dispenser of FIG. 2.
Figure 4:
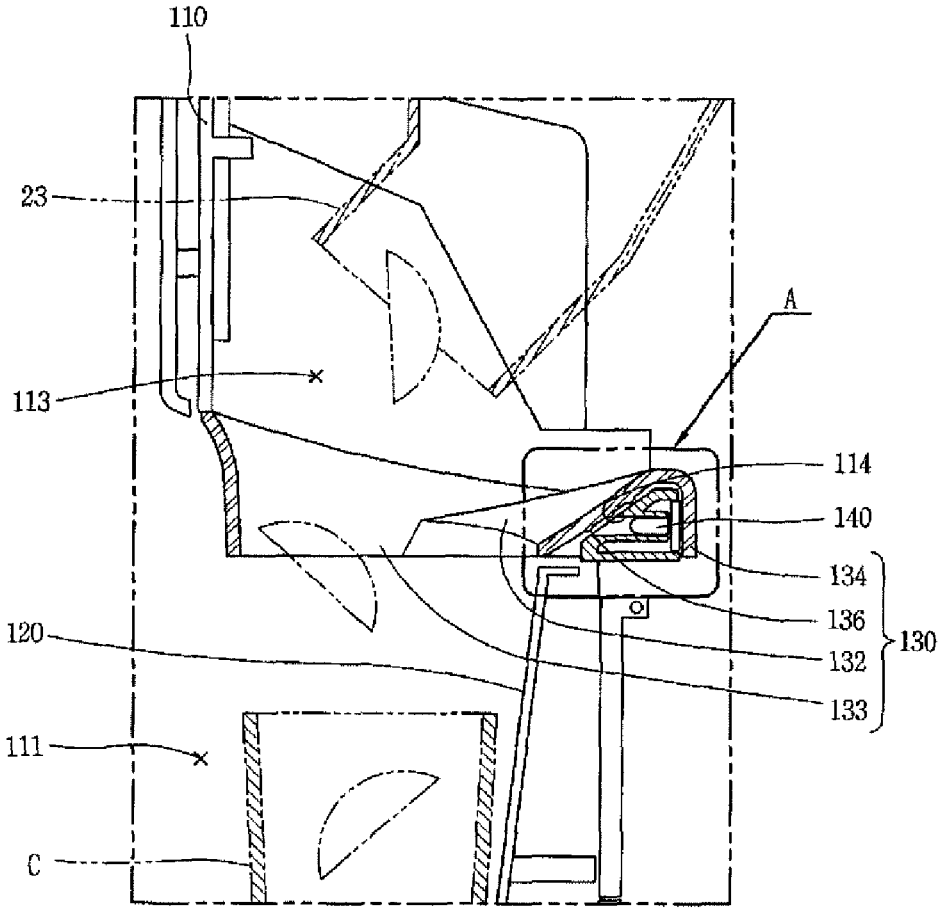
FIG. 4 is a sectional view taken along line 'I-I' in FIG. 3.
Figure 5:
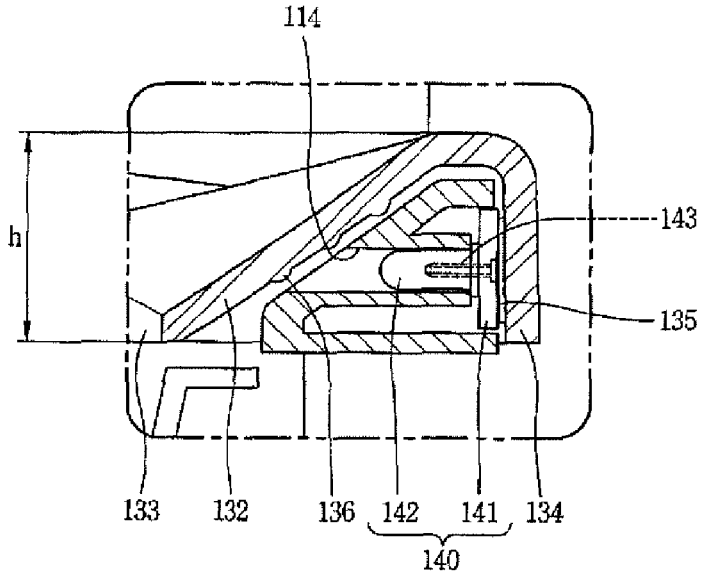
FIG. 5 is an enlargement view of a part of 'A' in FIG. 4.
Figure 6:
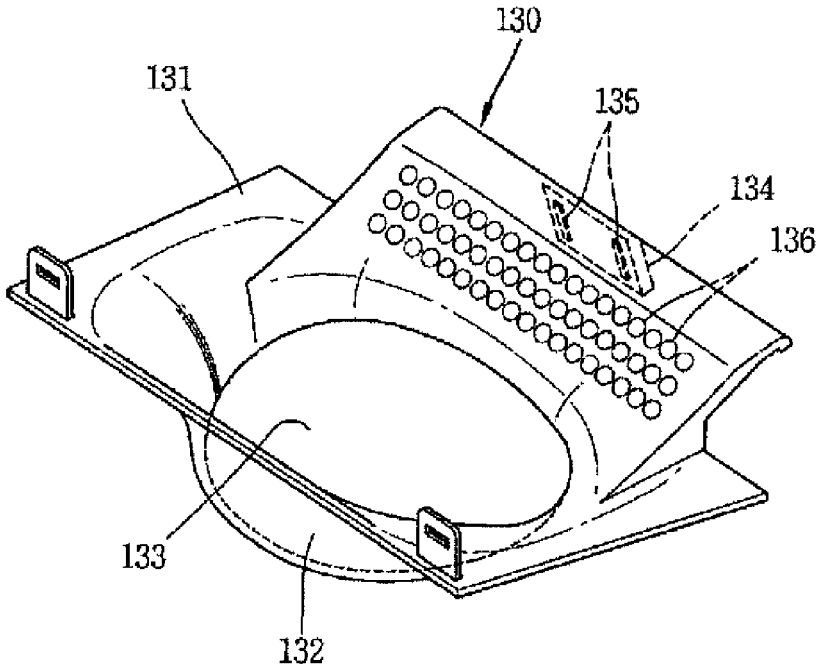
FIGS. 6 and 7 are front and rear perspective views showing a guide member of FIG. 4, respectively.
Figure 7:
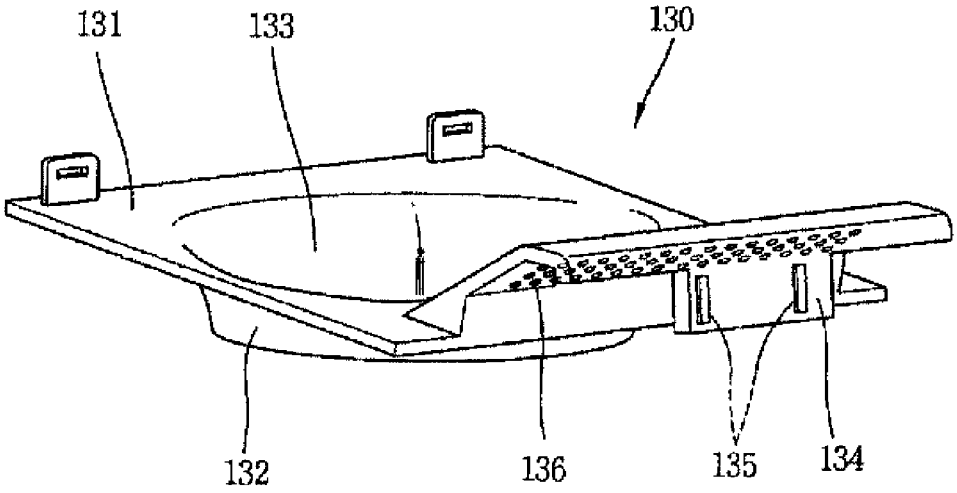
Figure 8:
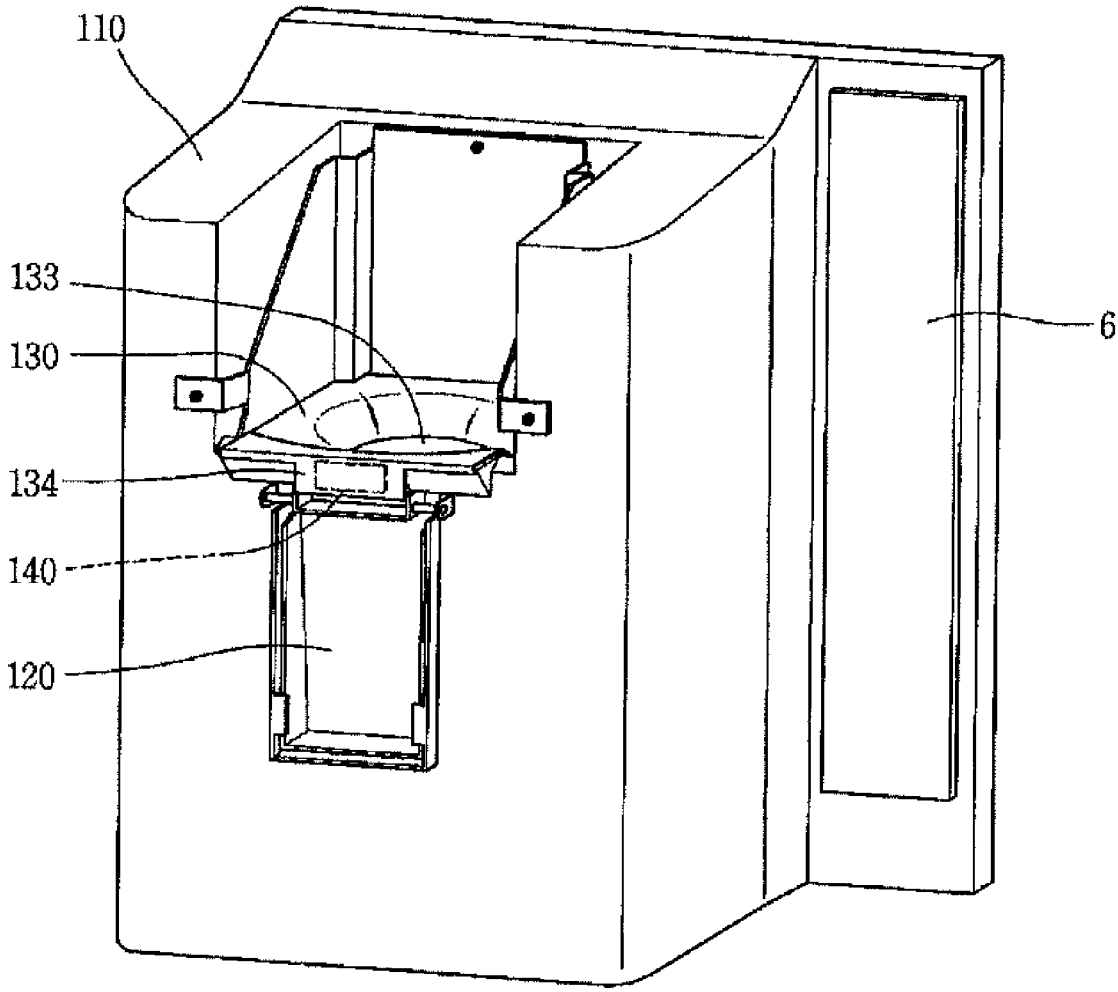
FIG. 8 is a rear perspective view of the dispenser of FIG. 1.
Figure 9:
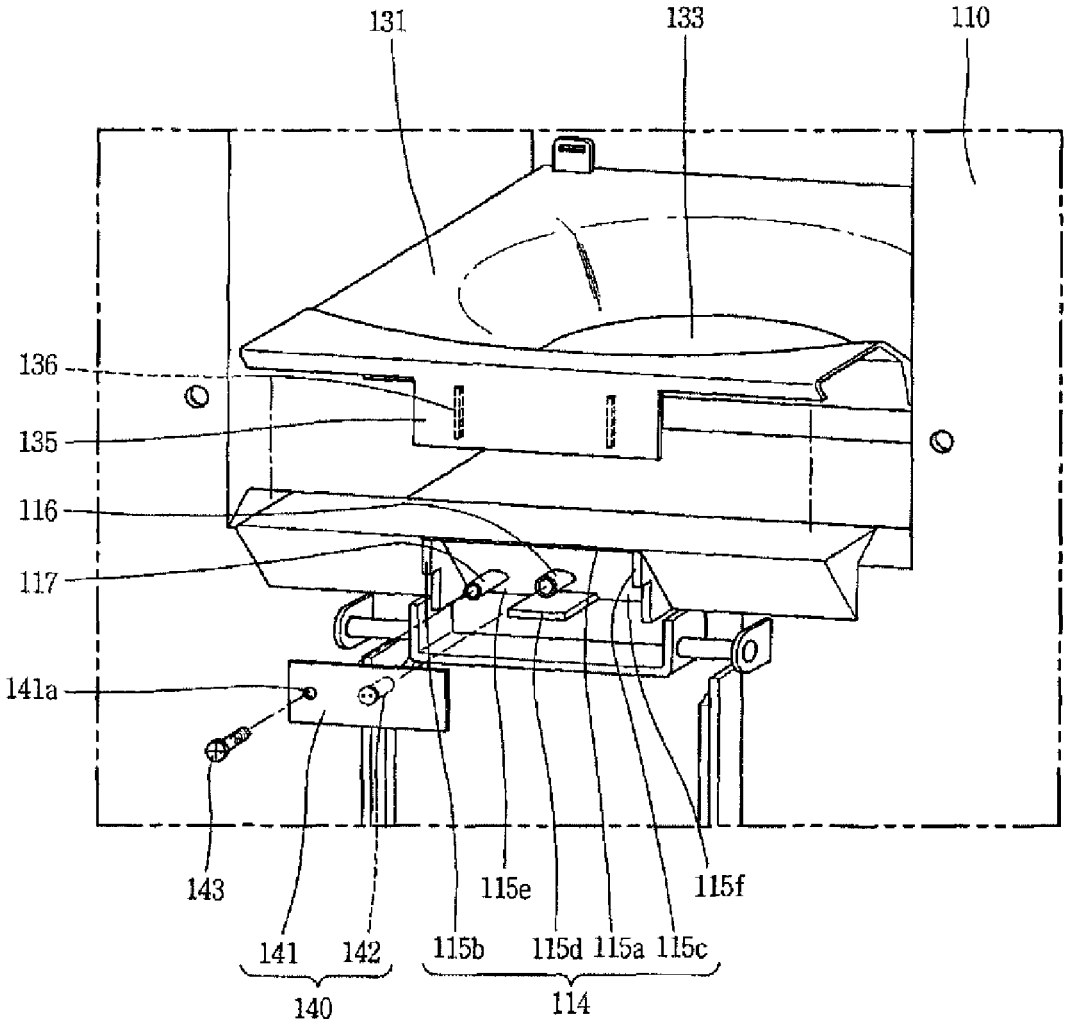
FIG. 9 is a disassembled perspective view of a guide member and an optical source to explain an optical source accommodation portion of the dispenser of FIG. 8.

FIG. 1 is a perspective view of a refrigerator having a dispenser according to the present invention, FIG. 2 is a perspective view of the refrigerator having a dispenser according to the present invention, which shows a state that a door has opened, FIG. 3 is a frontal view of the dispenser of FIG. 2, FIG. 4 is a sectional view taken along line 'I-I' in FIG. 3, FIG. 5 is an enlargement view of a part of 'A' in FIG. 4, FIGS. 6 and 7 are front and rear perspective views showing a guide member of FIG. 4, respectively, FIG. 8 is a rear perspective view of the dispenser of FIG. 1, and FIG. 9 is a disassembled perspective view of a guide member and an optical source to explain an optical source accommodation portion of the dispenser of FIG. 8.

As shown in FIGS. 1 and 2, the refrigerator according to the present invention comprises a refrigerator body 1 having a storage chamber 11 for storing food items therein, and refrigerator doors 2 and 3 coupled to the refrigerator body 1 and configured to open and close an opening of the storage chamber 11.

The refrigerator body 1 is formed so that a refrigerating chamber 12 and a freezing chamber 13 of the storage chamber 11 are partitioned from each other by a partition wall 14, and are opened toward the front side. A mechanical chamber (not shown) configured to accommodate therein each kind of components such as a compressor (not shown) and a condenser (not shown) is formed at a lower rear side of the refrigerator body 1.

An ice making chamber 20 configured to make ice cubes and to store them is formed on an inner wall surface of one of the two refrigerator doors 2 and 3, especially, the freezing chamber door 3. An ice storage container 22 configured to store ice cubes made by an ice maker 21 is installed below the ice maker 21. And, a dispenser configured to discharge the ice cubes without opening the freezing chamber door 3 is installed below the ice storage container 22.

Referring to FIG. 3, a display portion 4 configured to display an operation state of the refrigerator, and a manipulation portion 5 configured to allow a user to manipulate the dispenser 100 or the refrigerator are provided at one side of the dispenser 100.

An ice discharge duct 23 configured to guide the ice cubes stored in the ice storage container 22 to the dispenser 100 is formed between the ice storage container 22 and the dispenser 100. And, a duct cap (not shown) configured to selectively open and close the ice discharge duct 23 is installed at an outlet of the ice discharge duct 23.

As shown in FIGS. 3 to 5, the dispenser 100 includes a dispenser housing 110 and a press switch 120, and the dispenser housing 110 is formed to have a predetermined inner space 111. The dispenser housing 110 is fixed to a front surface of the freezing chamber door 3, and the press switch 120 is installed on a rear surface of the dispenser housing 100 and configured to selectively discharge ice cubes according to a user's pressing operation.

The inner space 111 of the dispenser housing 110 is formed to be concaved toward the rear side, i.e., the toward the storage chamber of the refrigerator, so that a cup containing water or ice cubes therein can be located at the concaved position. A front opening 112 is formed at a front surface of the dispenser housing 110 so that the user can discharge water or ice cubes therethrough. An ice discharge opening 113 configured to discharge ice cubes therethrough is formed on an upper surface of the dispenser housing 110 as the ice discharge duct 23 and the inner space 111 of the dispenser housing 110 are communicated with each other.

A guide member 130 configured to guide the ice cubes discharged through the ice discharge duct 23 to the cup (C) is installed at the ice discharge opening 113 of the dispenser housing 110.

Referring to FIGS. 6 and 7, the guide member 130 includes a flange portion 131 formed in a plate shape so as to cover the ice discharge opening 113 of the dispenser housing 110, and a guide portion 132 protruding from a central part of the flange portion 131 toward a bottom surface of the dispenser housing 110 by a predetermined height. The guide portion 132 is configured to guide the ice cubes discharged through the ice discharge duct 23 to the cup (C) by being communicated with the ice discharge opening 113. And, a guide hole 133 is penetratingly formed at the guide portion 132 so as to guide discharge of the ice cubes. At one side of the flange portion 131, i.e., at a part corresponding to a rear side surface of the dispenser housing 110, a cover portion 134 is formed so as to accommodate an LED 140 therein by covering a rear surface of the LED which will be later explained. At an inner surface of the cover portion 134, i.e., at a surface facing the LED (optical source), one or more ribs 135 are protrudingly formed so as to stably support the LED 140 in a pressing manner and to reinforce a strength of the LED 140.

Preferably, the guide member 130 is formed of a transparent material or a semi-transparent material so as to smoothly disperse light transmitted from the LED 140 as an optical guide. At one side of the guide member 130 corresponding to a front side of a rear surface of the dispenser housing 110, i.e., between the guide portion 132 and the cover portion 134, may be formed a light dispersion portion 136 configured to disperse particles of light. The light dispersion portion 136 may be protruded or concaved with a minute pattern.

As shown in FIGS. 8 and 9, an optical source accommodation portion 114 configured to insertion-mount the optical source 140 is protruding, by a predetermined height, from a rear surface of the dispenser housing 110, i.e., a wall surface of the refrigerator.

As shown in FIG. 9, the optical source accommodation portion 114 includes an upper protrusion 115*a*, side protrusions 115*b* and 115*c*, and a lower protrusion 115*d*. The upper protrusion 115*a* is protruding from the ice discharge opening 113 toward a rear surface of the dispenser housing 110, and accommodates an upper surface of a substrate portion 141 of the optical source 140. The side protrusions 115*b* and 115*c* are vertically protruding from a bottom surface of the upper protrusion 115*a* with an interval therebetween, and accommodate therein right and left side surfaces of the substrate portion 141. And, the lower protrusion 115*d* is formed between the two side protrusions 115*b* and 115*c*, and accommodates therein or support a bottom surface of the substrate portion 141.

The upper protrusion 115*a* may be formed to have a length greater than an interval between the side protrusions 115*b* and 115*c*, e.g., may be formed to cross the entire part of the ice discharge opening in a horizontal direction, so that ice cubes discharged through the ice discharge opening 113 or water generated during the ice making process can not be introduced into the optical source accommodation portion 114.

Cut out recess portions 115*e* and 115*f* having a predetermined depth may be formed near edges between the two side protrusions 115*b* and 115*c* and the lower protrusion 115*d*, respectively, so as to draw out electric lines therethrough.

A light transmitting hole 116 configured to insert a light emitting portion 142 of the optical source 140 may be formed on an inner side surface of the optical source accommodation portion 114, i.e., on a rear surface of the dispenser housing 110. As shown in FIG. 5, the light transmitting hole 116 is preferably formed within a height range (h) of the guide portion 132 of the guide member 130 so that a central part of light can be directly irradiated onto the guide member 130.

A coupling recess 117 configured to couple the substrate portion 141 of the optical source 140 may be formed at one side of the light transmitting hole 116. In this case, the coupling recess 117 may be formed in a boss shape having a predetermined height with consideration of a height of the light emitting portion 142 of the optical source 140.

As the optical source 140, a general bulb which emits light may be used. However, an LED having high efficiency and less power consumption is preferably used. More concretely, the optical source 140 includes a substrate portion 141 configured to receive an electric signal, and a light emitting portion 142 electrically connected to the substrate portion 141.

As aforementioned, the substrate portion 141 is mounted to the optical source accommodation portion 114 of the dispenser housing 110, and covered by the cover portion 135 of the guide member 130. The substrate portion 141 is coupled to inside of the optical source accommodation portion 114 by a coupling member 143, or is fixed thereto in a pressing manner. In the case of coupling the substrate portion 141 to inside of the optical source accommodation portion 114 by the coupling member 143, a through hole 141*a* is formed at the substrate portion 141 in correspondence to the coupling recess 117 of the dispenser housing 110.

The light emitting portion 142 is insertion-fixed to the light transmitting hole 116. Here, the light transmitting hole 116 is formed to be within the height range (h) of the guide portion 132 of the guide member 130, i.e., is formed to be positioned between the press switch 120 and the ice discharge opening 113 of the dispenser housing 110 disposed above the press switch 120. Accordingly, light emitted from the light emitting portion 142 can be directly irradiated onto the guide portion 132 of the guide member 130.

A pressure sensor (not shown) may be installed at the optical source 140 so that the optical source 140 can be interworked with the press switch 120. The pressure sensor may be electrically connected to a printed circuit board 6 which controls the operation of the dispenser 100. And, the optical source 140 may be set to be selectively turned ON/OFF through the manipulation portion 5 by a user. However, the optical source 140 may be automatically turned ON/OFF as a cup is put into or withdrawn from the dispenser 100.

Figure 10:
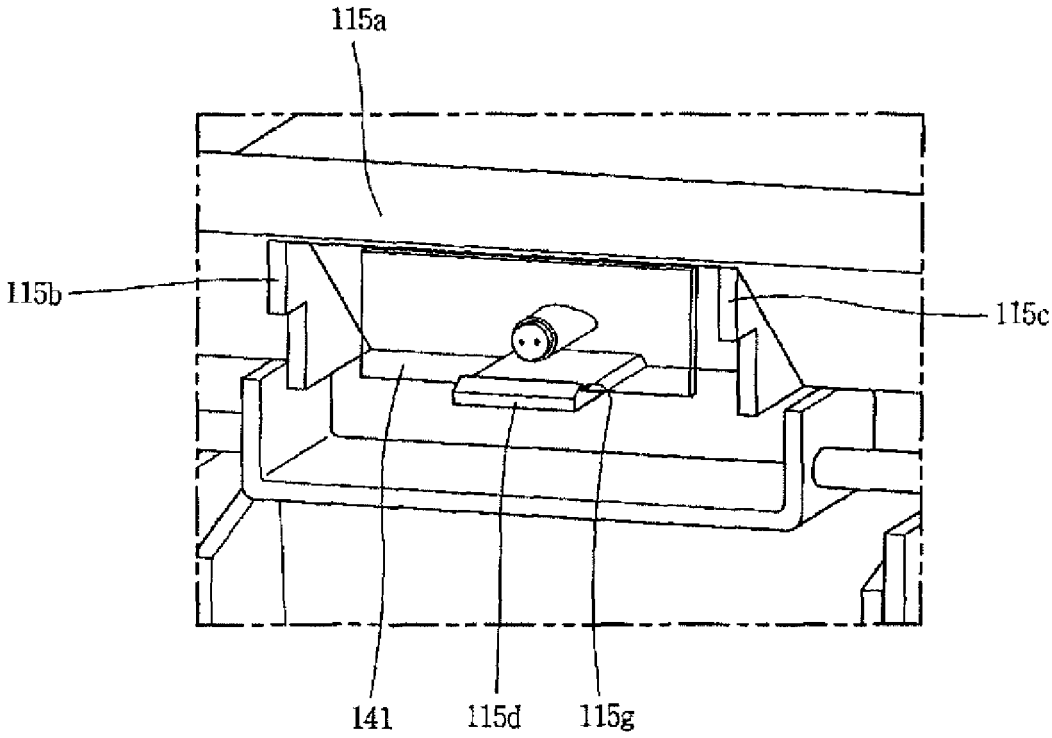
FIG. 10 is a schematic view showing another example to fix an optical source of the dispenser of FIG. 8 to an optical source accommodation portion.

Alternatively, the optical source 140 may be closely fixed to the dispenser housing 110 by using the guide member 130, not by using the coupling member. As shown in FIG. 10, a stepped portion 115*g* may be slantly formed on at least one of the side protrusions 115*b* and 115*c* and the lower protrusion 115*d*, such that the substrate portion 141 of the optical source 140 can be locked thereto by a hook.

The operational effects of the lighting device for the dispenser of the refrigerator according to the present invention will be explained.

Once the user turns on the optical source 140 through the manipulation portion 5, light is emitted from the optical source 140. The user may turn on the optical source 140 even during daytime, or only during nighttime when an interior lighting device is turned off. Alternatively, the optical source 140 may be automatically turned on when the user presses the press switch 120.

Light emitted from the optical source 140 is entirely dispersed at the guide member 130 as the guide member 130 is formed of a transparent material. Then, the light serves to evenly illuminate the entire part of the inner space 111 of the dispenser housing 110. Since the light dispersion portion 136 is formed at the guide member 130, light emitted from the optical source 140 is more widely dispersed at the light dispersion portion 136. Accordingly, the light illuminates the inner space 111 of the dispenser housing 110 more softly.

Furthermore, since the cover portion 135 of the guide member 130 covers the optical source 140, ice cubes discharged through the ice discharge duct 23 or water generated as the ice cubes melt are prevented from being introduced into the optical source 140. This may allow the optical source 140 to be installed within the range of the guide member 130, i.e., near the ice discharge opening 113, and may enhance a water leakage prevention function.

The inner space of the dispenser housing is softly illuminated by the optical source even during nighttime, thereby allowing the user to easily check a discharged degree of ice cubes or water with sophisticated aesthetic feeling. In the case of turning on the optical source during daytime, light emitted from the optical source softly illuminates the inner space of the dispenser housing. This may allow the user to have aesthetic feeling.

The optical source is covered by the cover portion of the guide member, and is fixedly mounted to the optical source accommodation portion disposed on a rear surface of the dispenser housing. Accordingly, the optical source may be installed near the ice discharge opening, and a water leakage prevention function may be enhanced. Furthermore, the optical source may be stably fixed to the optical source accommodation portion without using an additional coupling member or by using a small number of components. This may allow the number of components or assembly processes to be decreased, and the production costs to be reduced.

The lighting device for a refrigerator according to the present invention may be applied not only to a refrigerator having a dispenser, but also to a water purifier. Furthermore, the lighting device for a refrigerator according to the present invention may be applied to a refrigerator and a water purifier each having a water discharge function as well as an ice discharge function.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator, comprising:

a refrigerator body;

a refrigerator door coupled to the refrigerator body;

an ice maker disposed at the refrigerator body or the refrigerator door, and configured to make ice cubes;

a dispenser disposed at the refrigerator door;

a duct disposed between the ice maker and the dispenser, and configured to guide the ice cubes made by the ice maker to the dispenser;

a dispenser housing communicated with the duct, and having an ice discharge opening;

an optical source disposed at a peripheral region of the ice discharge opening, having a substrate portion configured to control the optical source and a light emitting portion electrically connected to the substrate portion; and a guide member disposed at the ice discharge opening, and configured to guide discharge of the ice cubes, wherein a cover portion configured to cover the optical source is formed at the guide member, wherein a light transmission hole is penetratingly formed at the dispenser housing such that light emitted from the optical source is forwardly irradiated, and wherein the light emitting portion is insertion-coupled to the light transmitting hole.

2. The refrigerator of claim 1, wherein the guide member is formed of a transmissive material through which light emitted from the optical source passes.

3. The refrigerator of claim 1, wherein the guide member is provided with a light dispersion portion configured to disperse light emitted from the optical source.

4. The refrigerator of claim 3, wherein the light dispersion portion is formed at a part facing the optical source.

5. The refrigerator of claim 1, wherein one or more ribs are formed at the cover portion of the guide member so as to support the optical source.

6. The refrigerator of claim 1, wherein an optical source accommodation portion configured to accommodate the optical source therein is formed at the dispenser housing, and the optical source accommodation portion is covered by the cover portion of the guide member.

7. The refrigerator of claim 6, wherein the optical source accommodation portion is formed on a rear surface of the dispenser housing.

8. The refrigerator of claim 1, wherein the optical source accommodation portion comprises:

an upper protrusion protruding from a rear surface of the dispenser housing, and configured to accommodate an upper surface of the substrate portion;

side protrusions protruding from both sides of the upper protrusion, and configured to accommodate right and left side surfaces of the substrate portion; and a lower protrusion protruding between the two side protrusions, and configured to accommodate a bottom surface of the substrate portion, wherein recesses having a predetermined depth are formed between the side protrusions and the lower protrusion.

9. The refrigerator of claim 8, wherein the optical source is coupled to inside of the optical source accommodation portion by a coupling member.

10. The refrigerator of claim 8, wherein a stepped portion configured to fix a rear surface of the substrate portion of the optical source is formed at the lower protrusion.

11. A lighting device for a refrigerator, comprising:

a refrigerator body;

a refrigerator door coupled to the refrigerator body;

a dispenser disposed at the refrigerator door;

an ice storage container disposed at the refrigerator body or the refrigerator door, and configured to store ice cubes therein;

a duct disposed at the refrigerator door, and configured to guide the ice cubes stored in the ice storage container to the dispenser;

a dispenser housing communicated with the duct, and having an ice discharge opening;

a switch installed at the dispenser housing so as to selectively discharge ice cubes from the dispenser;

an optical source disposed at a peripheral region of the ice discharge opening; and a guide member disposed at the ice discharge opening, and configured to guide discharge of the ice cubes, wherein the optical source is installed at the dispenser housing so as to be disposed between an upper end of the switch and the ice discharge opening, wherein the guide member comprises:

a flange portion formed in correspondence to the ice discharge opening of the dispenser housing; and a guide portion protruding from a central part of the flange portion toward a bottom surface of the dispenser housing by a predetermined height, wherein the optical source is disposed within a height range of the guide portion.

12. The lighting device for a refrigerator of claim 11, wherein the switch is installed on a rear surface of the dispenser housing, and wherein the optical source is installed on a rear surface of the dispenser housing above the switch.

13. The lighting device for a refrigerator of claim 11, wherein the guide member further comprises a cover portion extending from one edge of the flange portion and covering the optical source.

14. The lighting device for a refrigerator of claim 11, wherein the guide member further comprises a light dispersion portion formed in a protrusion or recess shape so as to disperse light emitted from the optical source.

15. A refrigerator, comprising:

a refrigerator body;

a refrigerator door coupled to the refrigerator body;

an ice maker disposed at the refrigerator body or the refrigerator door, and configured to make ice cubes;

a dispenser disposed at the refrigerator door;

a duct disposed between the ice maker and the dispenser, and configured to guide the ice cubes made by the ice maker to the dispenser;

a dispenser housing communicated with the duct, and having an ice discharge opening;

an optical source disposed at a peripheral region of the ice discharge opening, having a substrate portion configured to control the optical source and a light emitting portion electrically connected to the substrate portion; and a guide member disposed at the ice discharge opening, and configured to guide discharge of the ice cubes, wherein a cover portion configured to cover the optical source is formed at the guide member, wherein an optical source accommodation portion configured to accommodate the optical source therein is formed on a rear surface of the dispenser housing, and the optical source accommodation portion is covered by the cover portion of the guide member, wherein a light transmission hole is penetratingly formed at the dispenser housing such that light emitted from the optical source is forwardly irradiated, and wherein the light emitting portion is insertion-coupled to the light transmitting hole.

16. A refrigerator, comprising:

a refrigerator body;

a refrigerator door coupled to the refrigerator body;

an ice maker disposed at the refrigerator body or the refrigerator door, and configured to make ice cubes;

a dispenser disposed at the refrigerator door;

a duct disposed between the ice maker and the dispenser, and configured to guide the ice cubes made by the ice maker to the dispenser;

a dispenser housing communicated with the duct, and having an ice discharge opening;

an optical source disposed at a peripheral region of the ice discharge opening, having a substrate portion configured to control the optical source and a light emitting portion electrically connected to the substrate portion; and a guide member disposed at the ice discharge opening, configured to guide discharge of the ice cubes, and formed of a transmissive material through which light emitted from the optical source passes, wherein the guide member comprises:

a flange portion formed in correspondence to the ice discharge opening of the dispenser housing;

a guide portion protruding from a central part of the flange portion toward a bottom surface of the dispenser housing by a predetermined height;

a guide hole penetratingly formed at the guide portion so as to guide discharge of the ice cubes; and a cover portion that is configured to cover the optical source and that is formed at the flange portion.

17. The refrigerator of claim 16, wherein the guide member is provided with a light dispersion portion configured to disperse light emitted from the optical source.

* * * * *